US006139383A

United States Patent [19]

Jolly et al.

[11] Patent Number: 6,139,383

[45] Date of Patent: Oct. 31, 2000

[54] FIN ASSEMBLY

[75] Inventors: Barry Allan Jolly, Burleigh; Mark Sydney Palmer, Elanora, both of Australia

[73] Assignee: Pat-Tech Pty Ltd., Queen Island, Australia

[21] Appl. No.: 09/284,596

[22] PCT Filed: Oct. 27, 1998

[86] PCT No.: PCT/AU98/00897

§ 371 Date: Apr. 16, 1999

§ 102(e) Date: Apr. 16, 1999

[87] PCT Pub. No.: WO99/21755

PCT Pub. Date: May 6, 1999

[30] Foreign Application Priority Data

| | | | |
|---|---|---|---|
| Oct. 27, 1997 | [AU] | Australia | PP0025 |
| Dec. 9, 1997 | [AU] | Australia | PP0805 |
| Jun. 10, 1998 | [AU] | Australia | PP4015 |

[51] Int. Cl.[7] ..... B63B 35/79; B63B 35/00

[52] U.S. Cl. ..... 441/74; 114/39.15

[58] Field of Search ..... 441/74, 79, 65; 114/127, 138, 140, 142, 274, 126, 39.15

[56] References Cited

U.S. PATENT DOCUMENTS

| | | | |
|---|---|---|---|
| 3,422,471 | 1/1969 | Morey . | |
| 3,585,663 | 6/1971 | Johnson | 9/310 |
| 3,659,300 | 5/1972 | Johnson | 9/310 E |
| 3,965,514 | 6/1976 | Shafer . | |
| 4,325,154 | 4/1982 | Collum | 441/74 |
| 4,379,703 | 4/1983 | Mizell . | |
| 5,176,096 | 1/1993 | Molnar . | |
| 5,328,397 | 7/1994 | Whitty | 441/79 |
| 5,464,359 | 11/1995 | Whitty | 441/79 |
| 5,934,962 | 8/1999 | Daum et al. | 441/79 |

FOREIGN PATENT DOCUMENTS

| | | | |
|---|---|---|---|
| 84472/75 | 3/1977 | Australia | A53C 15/00 |
| 73654/81 | 7/1981 | Australia . | |
| 34088/93 | 9/1993 | Australia | B63B 35/79 |
| 40799/96 | 7/1996 | Australia | B63B 35/79 |
| 39334/97 | 4/1998 | Australia | B63B 35/79 |
| 0 034 990 | 9/1981 | European Pat. Off. . | |
| WO 88/07883 | 10/1988 | WIPO . | |
| WO 90/02589 | 3/1990 | WIPO . | |

OTHER PUBLICATIONS

International Search Report of PCT/AU98/00897 by Australian Searching Authority of the PCT.

*Primary Examiner*—Mark T. Le
*Assistant Examiner*—Patrick Craig Muldoon
*Attorney, Agent, or Firm*—Colin P. Abrahams

[57] ABSTRACT

A fin assembly [10] is provided for detachably removing a fin [12] in a surfboard [13]. The fin [12] has a mounting base [26] and spigots [22 and 23] projecting from front and rear positions on the base [26]. A socket mounting [11] defining at least complementary front and rear sockets [15 and 16] for receiving the spigots [22 and 23] is provided for inclusion in the board [13] for releasably mounting the fin [12] to the board. A grub screw or screws [35] is/are provided for securing the fin [12] in said mounting [11].

23 Claims, 13 Drawing Sheets

FIN ASSEMBLY

This invention relates to a fin assembly. This invention relates particularly to a fin assembly having a fin component which is readily detachable from its mountings.

This invention relates particularly to fin assemblies for surfboards and it will be convenient to hereinafter describe the invention with reference to this application. However it is to be clearly understood that the invention has broader application. For example it extends to other water craft such as sailing craft, paddle skis and surf skis and the like. For convenience such craft will be referred to collectively hereinafter as "boards".

Surf boards comprise broadly a body having a core of buoyant material, an upper ride surface for supporting a surfer and a lower surface which is received in the water. One or more fins are mounted on the lower surface thereof. Traditionally the fins have been permanently mounted to the body by being fibreglassed onto the body.

The disadvantage of permanently mounting a fin to a surfboard is that it cannot be easily removed and replaced when the fin is damaged. Further the fin cannot be easily removed from the board and replaced with another fin having different performance properties to enable experimentation with different fin types to occur. Further when transporting surfboards, the fin is relatively ungainly and consumes a large amount of space. Accordingly it would be advantageous in such situations to be able to remove the fin from the body of the board.

A removable fin assembly has been developed which is described in Australian patent 665804. This fin assembly comprises a fin having two thin rectangular tabs projecting outwardly from the base of the fin. Each such tab is received within a socket of a disc-like plug mounted in the lower surface of the body of the surfboard. The fin tabs are releasably locked in the plug by means of opposed fastening elements such as grub screws which clamp the tab. However this assembly has limited strength.

This fin assembly also has other shortcomings. For example this fin assembly requires precision work for it to be mounted on the body of the surfboard. This is because the two spaced plugs have to be spaced a precise distance apart to enable them to mate with the two fin attachment elements in order to provide ease of attachment and release of the fin means. In addition a number of grub screws is used to secure each fin and thus it is time consuming to mount a fin to the board.

A further feature of the fin assembly is a resin plug which extends from the bottom of the body attachment element through the core of the body to the upper ride surface of the surfboard. This resin plug provides some support for the fin attachment element to assist in mounting it in stable fashion on the body of the surfboard. However after use this resin plug tends to work through the fibreglass coating on the ride surface of the surfboard. This is unsightly and causes water leakage into the inner core of the board. The so formed discontinuity in the ride surface may injure the rider.

Another disadvantage associated with such arrangements is that the fin body projects forwardly and rearwardly beyond the tabs and in use these portions of the fin body are positioned in abutting relationship with or adjacent to the lower surface.

Accordingly, during attempts to remove the fin from the plugs secured into the board, and especially if the plugs are not perfectly aligned with the tabs, the projecting ends will be forced against the bottom surface to effect leverage to assist in such removal. This is often effected by rocking the fin to and fro. This action causes the projecting ends to damage the fibreglass skin forming the lower surface.

It would therefore be advantageous if an improved fin assembly which enabled the removable detachment of a fin to a body of a surfboard could be devised.

According to one aspect of this invention there is provided a fin assembly including:

a fin body having a mounting base and spigots projecting from front and rear positions on the base;

a socket mounting for inclusion in a board for releasably mounting the fin assembly to the board, the socket mounting defining at least complementary front and rear sockets for receiving said spigots;

alignment means for maintaining operative alignment of the sockets whereby the spigots may freely enter and be withdrawn therefrom, and releasable securing means for securing the fin assembly in said mounting.

Typically the fin body has a base and a tip and opposed major surfaces extending from the base to the tip.

The alignment means may be a web, beam portion or truss spanning between the sockets so as to maintain them positionally fixed with respect to one another.

Alternatively the alignment means may be a channel member formed with its open face opening to either the interior of the board or the exterior thereof and in the latter instance the channel member may constitute a socket for receiving a brace extending between the spigots.

The brace may constitute an intermediate socket portion interconnecting the front and rear sockets.

The spigots may be any suitable section such as round and/or tapered and may engage in complementary sockets which permit withdrawal of the spigots from the sockets in a direction substantially perpendicular to the adjacent surface of the board. Preferably the spigots have a substantially constant fore and aft section throughout their length and slope either forwardly or rearwardly from the fin body such that in use their engagement in complementary sockets obstructs removal of the fin body from the mounting in a direction perpendicular to the board.

In another aspect this invention resides broadly in a fin assembly including:

a fin body having a mounting base and spigots projecting from front and rear positions on the base;

a front socket and rear socket for inclusion in a board for receiving the spigots for releasably mounting the fin assembly to the board;

releasable securing means for securing the fin assembly in said mounting, wherein the spigots have a substantially constant fore and aft section throughout their length and slope either forwardly or rearwardly from the fin body such that in use their engagement in complementary front and rear sockets obstructs removal of the fin body from the mounting in a direction perpendicular to the board.

In yet a further aspect this invention resides broadly in a fin assembly including:

a fin body having a base and a tip and opposed major surfaces extending from the base to the tip and a spigot projecting from at least a major portion of the fin base;

a socket mounting for inclusion in a board and providing a socket for receiving the spigot for releasably mounting the fin assembly to the board, and;

releasable securing means for securing the spigot in said mounting.

The spigot suitably has a substantially rectangular cross-section which may be substantially constant throughout the length of the spigot or it may taper from the fin body. Preferably the spigot has front and rear guide walls which are parallel to one another and which slope either forwardly or rearwardly from the fin body such that in use their engagement in complementary front and rear sockets obstructs removal of the fin body from the mounting in a direction perpendicular to the board.

The spigot may also include one or more lateral projections from either or both sides thereof and disposed parallel to the front and rear guide faces of the spigot or they may provide the front and rear guide faces. For example a lateral projection may be utilised to provide an abutment face for a grub screw extending through the socket mounting.

In an arrangement in which the front and rear spigots or front and rear locating faces of a spigot incline forwardly or rearwardly, the fin is positively restrained against rocking in either a forward or a rearward direction respectively and only one releasable securing element is required to restrain rocking movement of the fin in the respective opposite direction and thus provide effective securing of the fin body to the mounting.

Furthermore prevention of such rocking restrains the base ends of the fin body from pressing into and possibly damaging the skin of the board. Furthermore when the securing means is released rocking of the fin in the opposite direction to which the spigots incline, after release of the securing means, will normally instigate a removal action of the fin body and thus space the fin base from the board and prevent the ends thereof engaging with the board.

Preferably the spigots slope forwardly from the base and the securing means is associated with the front socket to prevent rocking in the rearward direction. Such rocking will otherwise occur because the sloping front face will be in a plane which is close to tangential to the arc of rocking whereby any clearance between the socket and spigot will permit limited rocking.

Another advantage of an arrangement in which the spigot (s) incline forwardly or rearwardly and are accommodated within complementary sockets is that a grub screw passing through the socket mounting to engage an inclined face of the socket may be effectively used as the securing means and be inclined further from the horizontal compared to its use with a socket having its walls substantially perpendicular to underside surface of the board.

The fin body of the above defined inventions is suitably moulded of plastics material integrally with the socket(s). The fin body may have a symmetrical or asymmetrical cross-section.

The socket mounting is suitably formed as a one piece plastics moulding and of relatively stiff material. Preferably the socket mounting is formed as a dumb bell or dog bone shaped housing so as to accommodate front and rear lateral extensions of the spigot(s). It is also preferred that the socket mounting be formed with a channel shaped intermediate portion which accommodates an intermediate spigot portion.

The outer surface of the socket mounting may be patterned to mechanically interlock with the board or to increase the area in contact with the body of the board.

The releasable securing means for securing the fin assembly in said mounting may be a screw, a grub screw or a locking pin or other means for retaining the spigots engaged in the sockets, such as integral clips or the like.

The front and rear spigots or spigot portions suitably is of cruciform form in cross-section. These portions suitably extend further from the fin base than the central portion.

The fin assemblies variously defined above may be formed with an upstanding collar about the top wall of the socket mounting and surrounding the socket or sockets and also formed with temporary supports spaced outwardly from the collar and terminating at or adjacent the level of the top wall.

In another aspect this invention resides in a method of fitting a fin assembly to a board, including:

providing a fin assembly as defined in the preceding paragraph;

forming a recess in the board to accommodate the socket mounting;

temporarily suspending the socket mounting in the recess on the temporary supports engaged with the surface of the board surrounding the recess;

filling the space in the recess surrounding the socket mounting with a bonding agent and allowing it to set;

removing the collar and temporary supports, and as required securing the spigot or spigots on the fin body into the socket or sockets in the socket mounting.

A fin assembly in accordance with this invention may manifest itself in a variety of forms. It will be convenient to hereinafter describe in detail several preferred embodiments of the invention with reference to the accompanying drawings. It is to be clearly understood however that the specific nature of this description does not supercede the generality of the preceding statements.

Figure 12:
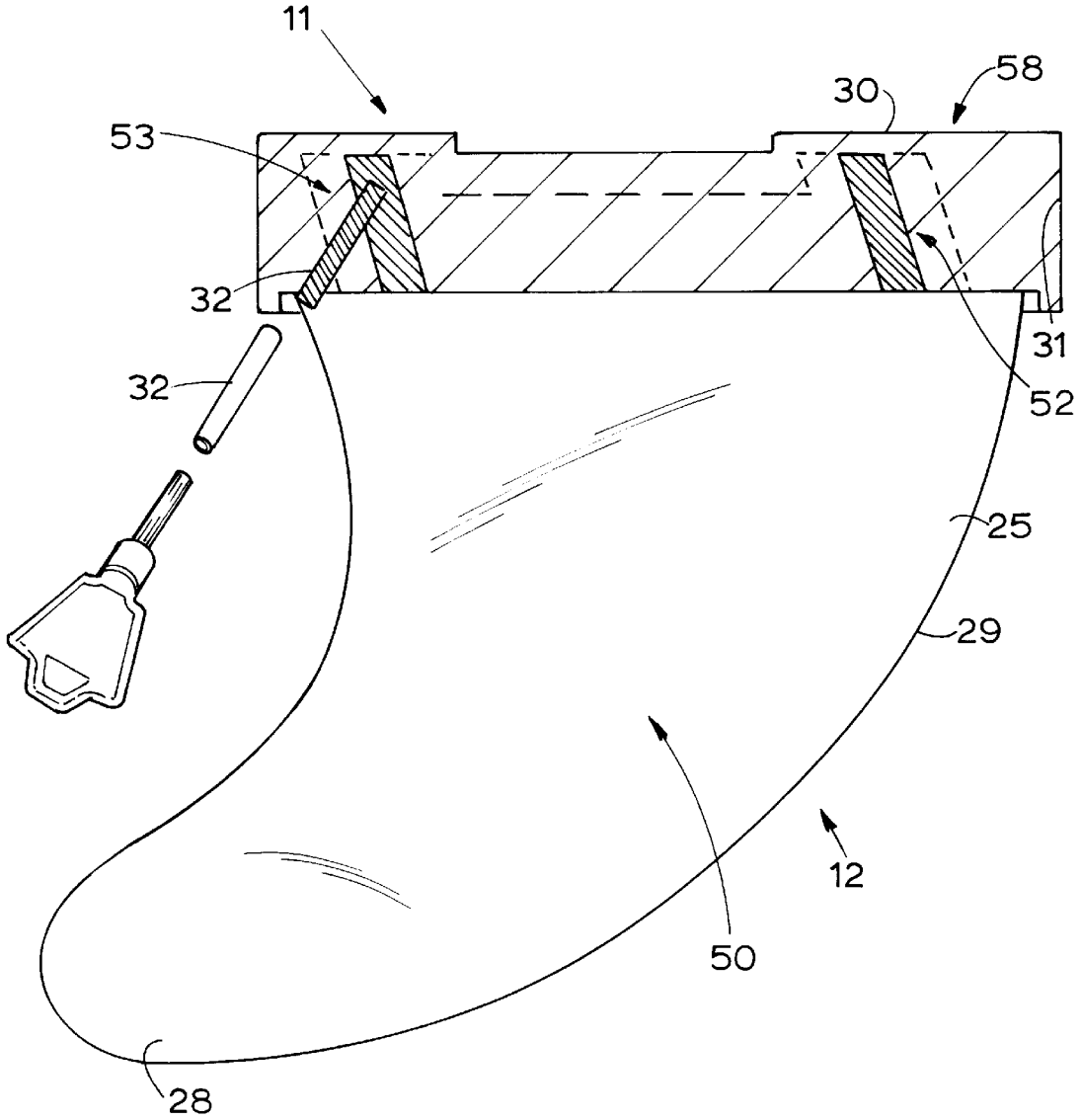
FIG. 12 is a part-sectional side view of the fin assembly of FIG. 6 showing attachment by means of a grub screw.
Figure 13:
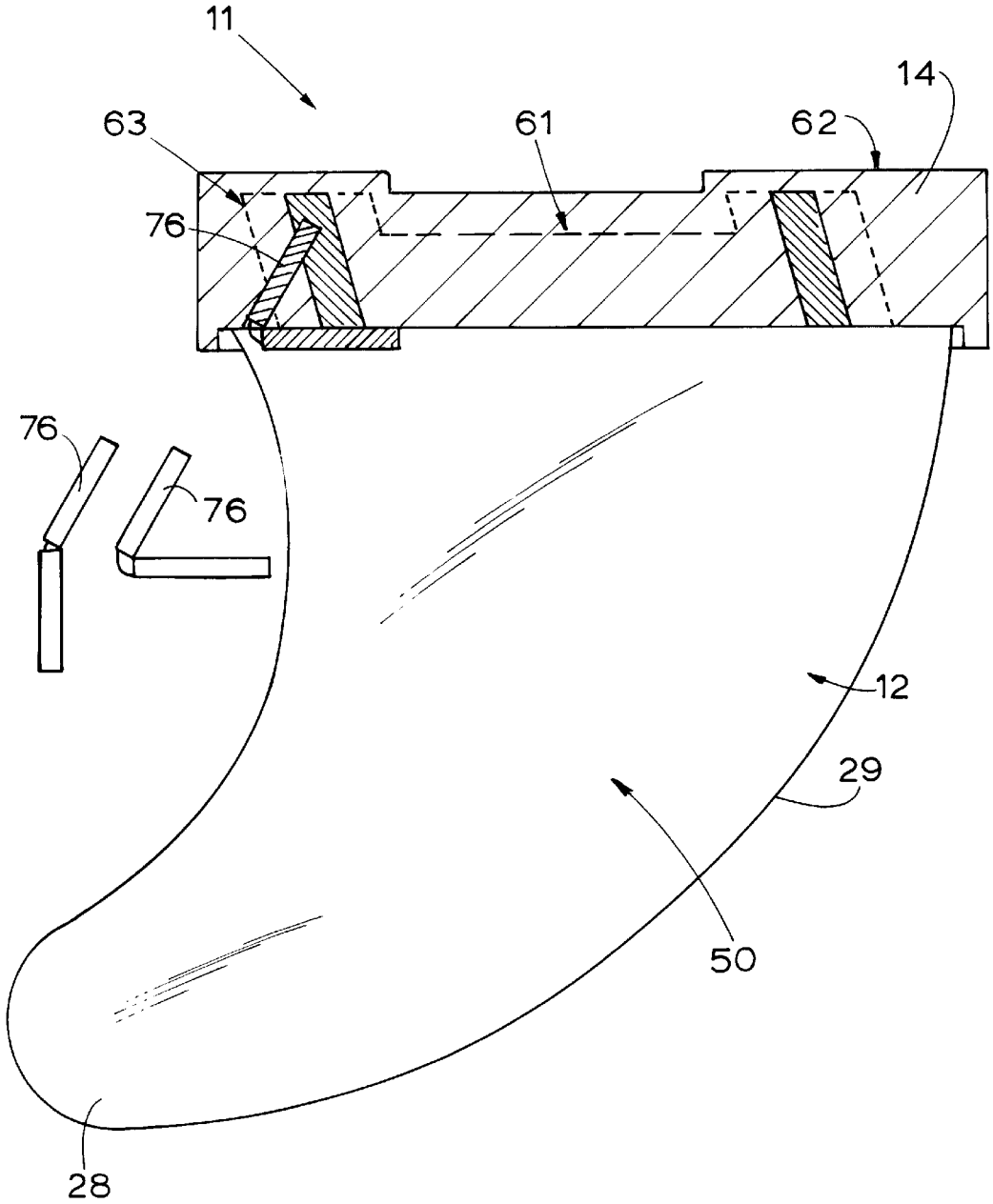
FIG. 13 is a part-sectional side view of the fin assembly of FIG. 6 showing attachment by means of a locking pin.
Figure 14:
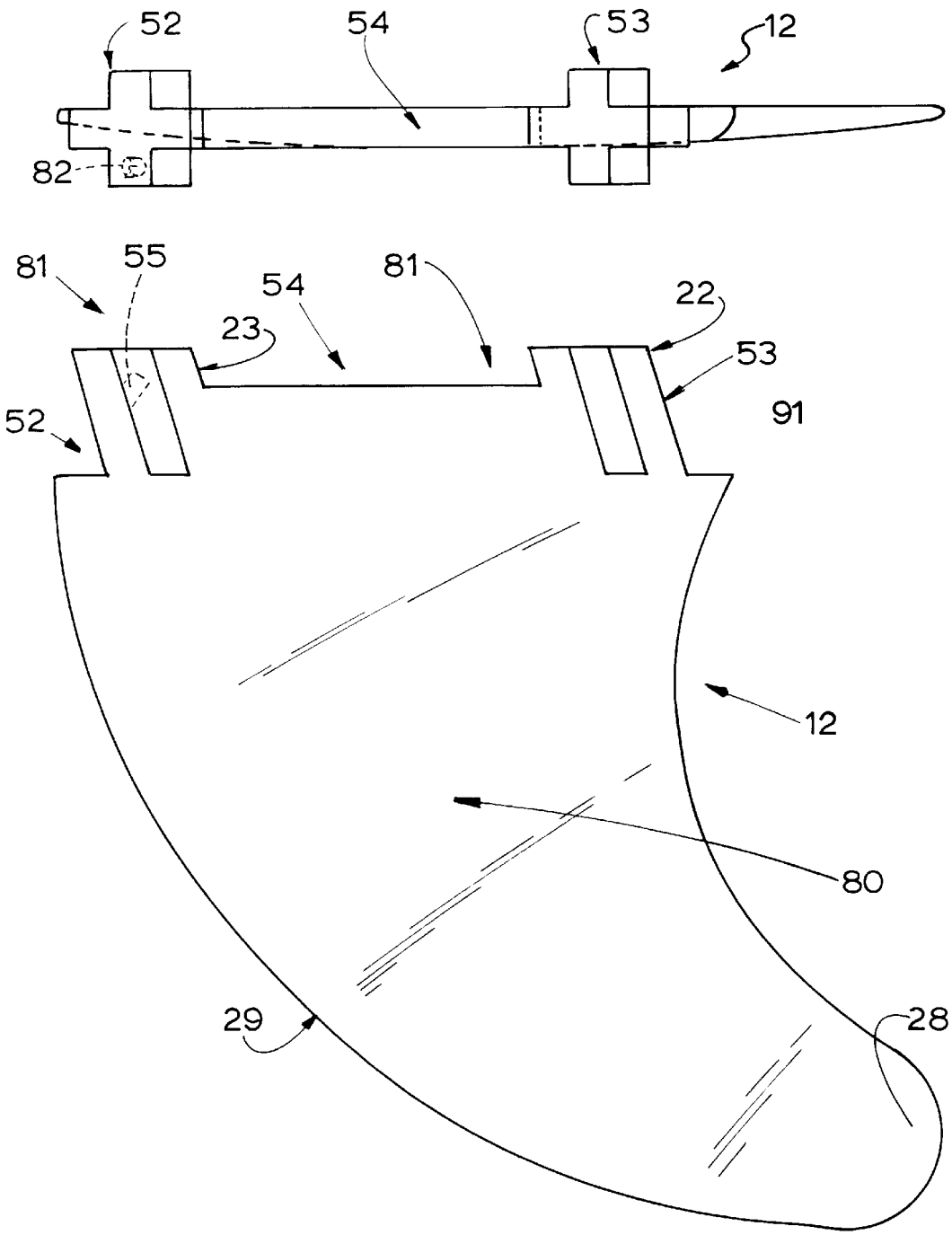
Figure 15:
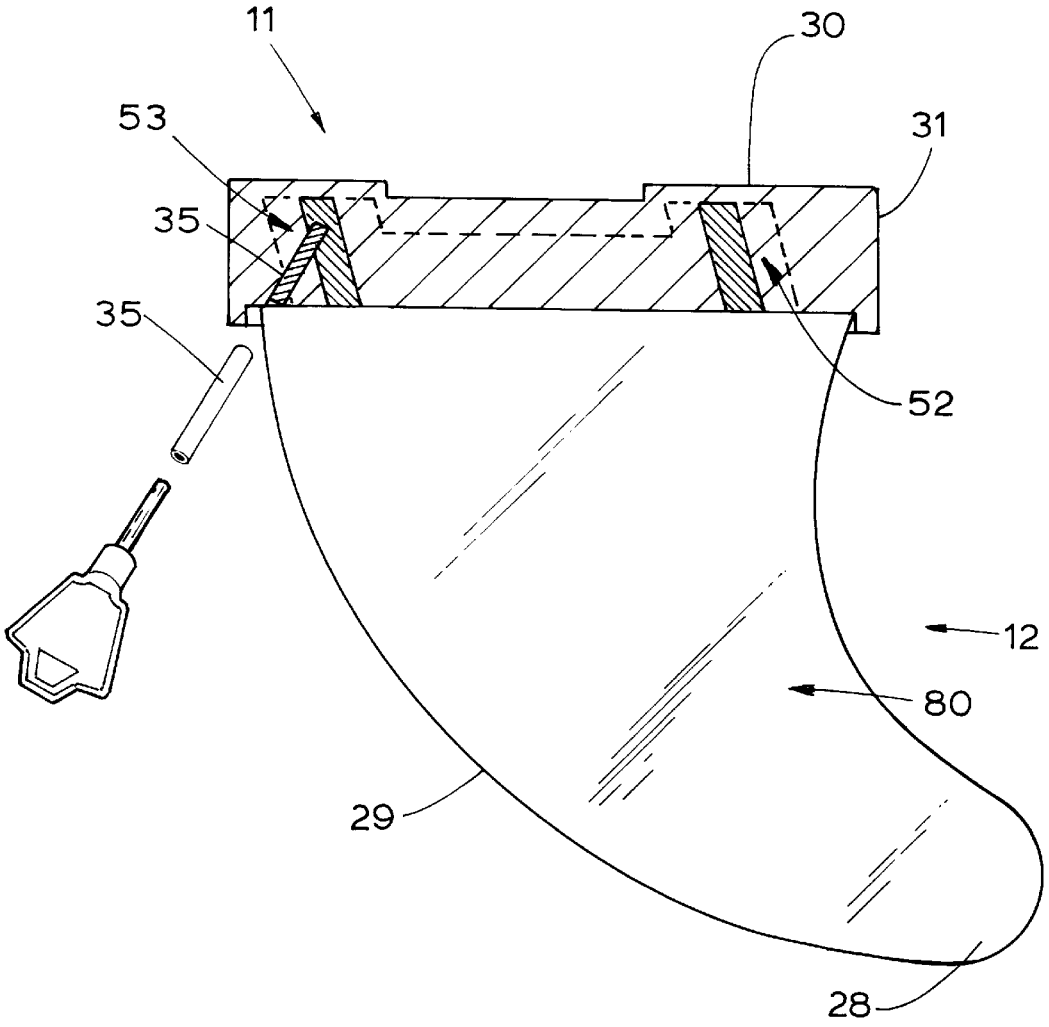
Figure 16:
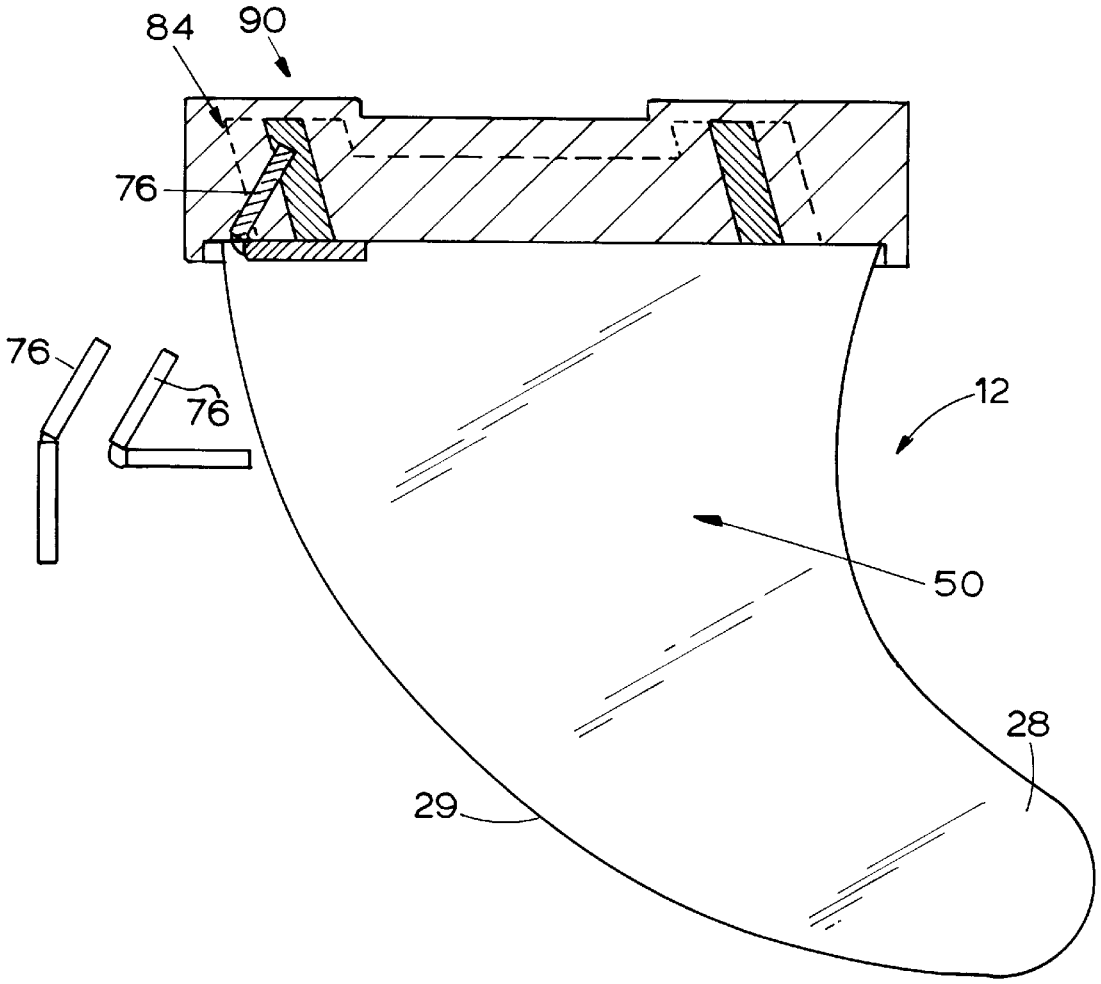

FIG. 14 collectively illustrate a further fin assembly in side and top views;

FIG. 15 corresponds to FIG. 12 and showing a forward inclination of the spigots, and FIG. 16 corresponds to FIG. 13 and showing a forward inclination of the spigots.

Figure 1:
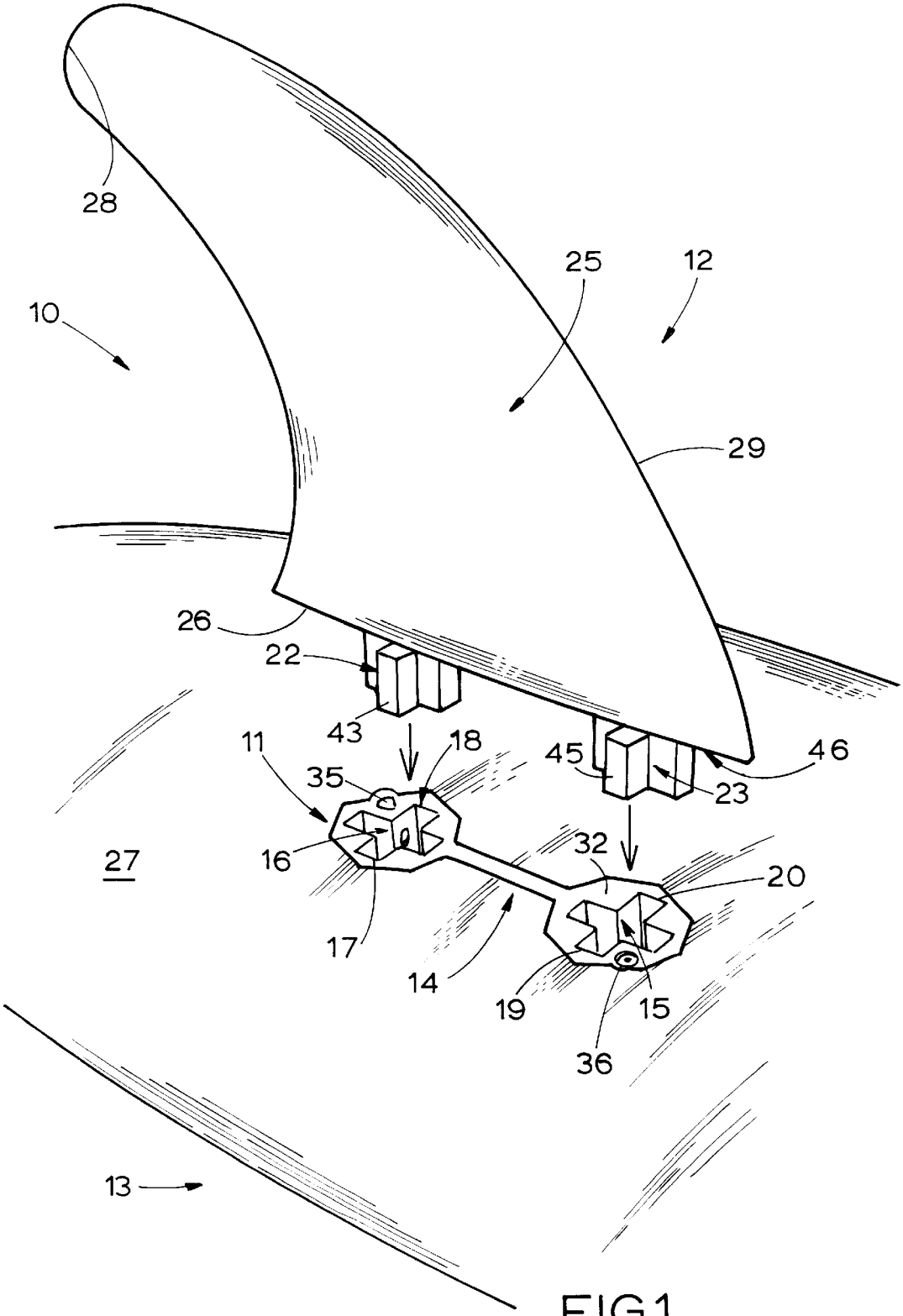
FIG. 1 is an exploded view of a fin assembly in accordance with a first embodiment of the invention.
Figure 2:
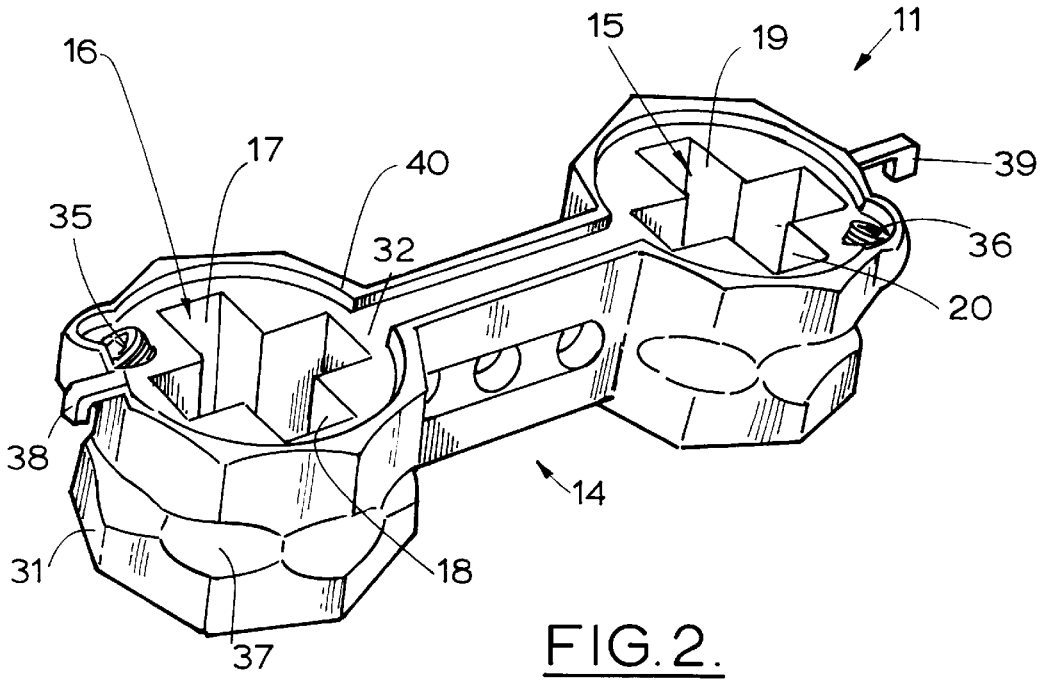
FIG. 2 is a three dimensional view of a socket mounting for the fin assembly of FIG. 1.

In FIG. 1 reference numeral 10 refers generally to a fin assembly which comprises a socket mounting 11 and a fin 12. The socket mounting 11 comprises an elongate dog bone shaped housing 14 defining sockets 15 and 16 at the enlarged ends thereof. Each of the sockets 15 and 16 is of cruciform section. When the housing 14 is secured into a surfboard, only part of which is illustrated at 13, so as to locate the fin 12 in a fore and aft position, the arms 17, 18, 19 and 20 projecting transversely of the board 13.

The fin 12 includes a fin body 25 and a pair of fin attachment spigots 22 and 23. The fin body 25 extends from a base 26, which in use is positioned adjacent the lower surface 27 of the board 13, to a rounded tip 28 remote from the base 26. Stability of the leading edge 29 of the fin 12 is important in achieving desired performance characteristics of any particular fin 12 and thus a rigid mounting of the fin is desirable.

The housing 14 of the socket mounting 11 has a bottom 30, a side wall 31 and a top wall 32. Each socket 15 and 16 has an associated passageway 33 angled down from the top wall 32 of the socket mounting 11 to the interior of the socket 15 or 16. These passageways 33 are threaded to receive a grub screw 35 or 36 which may be inserted and rotated to enter the sockets 15 and 16. The walls of the sockets 15 and 16 diverge outwardly and downwardly into the sockets. This feature assists in the secure fixing of the fin 12 to the attachment socket mounting 11 as will become apparent.

The side wall 31 is multi-faceted as illustrated in the drawings. This feature helps resist movement of the socket mounting 11 in the board 13 when fin loads are applied to the socket mounting 2.

A horizontally extending groove 37 is recessed in the side wall 31 of the housing 14 to assist in the flow of resin in and around the socket mounting 11 when it is being bonded in a board 13.

The socket mounting 11 includes temporary supports 38 and 39 extending from each end of the socket mounting 11 for positioning the socket mounting 11 at the surface 27 of a board 13. The temporary supports 38 and 39 engage the surface 27 beyond the cutout formed to receive the socket mounting 11 and locate the socket mounting 11 at the appropriate height relative to the surrounding surface 27 of the board body 13 during installation of the socket mounting.

The socket mounting 11 also has a collar 40 projecting upwardly proud of the top wall 32 thereof around the peripheral edge of the socket mounting 11 which is supported proud of the surface 27 when supported by the temporary supports. This prevents excess resin spilling into the sockets 15 and 16 when the socket mounting 11 is pushed into a resin filled cutout during installation.

Figure 3:
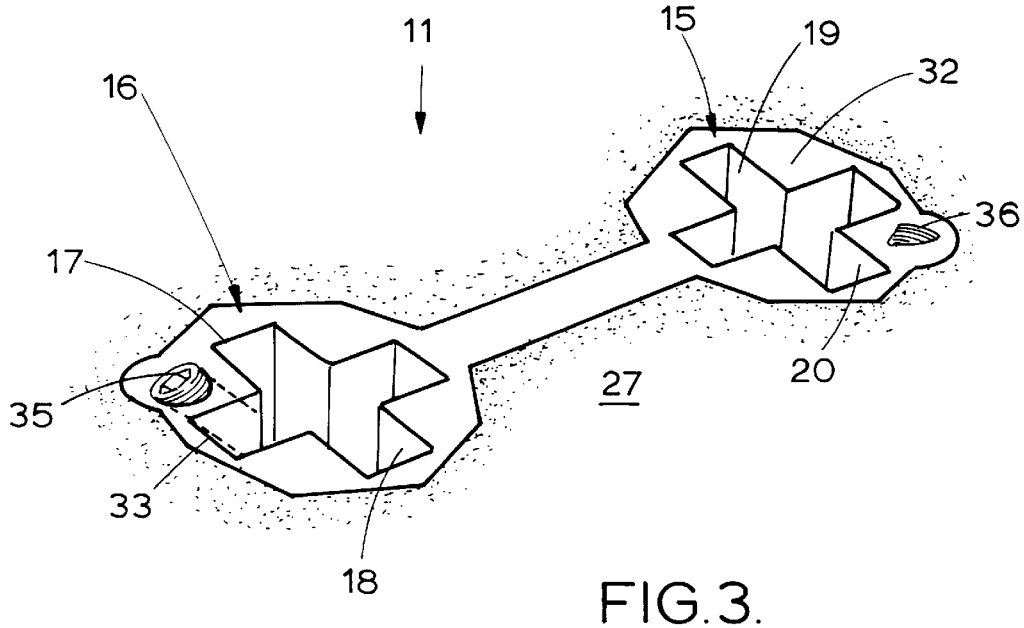
FIG. 3 illustrates the socket mounting in a board.

FIG. 3 shows the socket mounting 11 in a board body. The temporary supports 38 and 39 and the collar 40 have been sanded off in the mounting process such that the top wall 32 of the socket mounting 11 is flush with the surface 27 of the body 13.

The fin attachment spigots 22 and 23 are of complementary cruciform cross-section to the sockets 15 and 16 and are adapted to be received snugly therein and include lateral arms 43, 44, 45 and 46. Of these, arms 44 and 45 can be engaged by the grub screws 35 and 36.

In use the fin attachment spigots 22 and 23 are inserted in the sockets 15 and 16 so that the base 26 of the fin 12 abuts the top wall 32 of the socket mounting 2.

Figure 4:
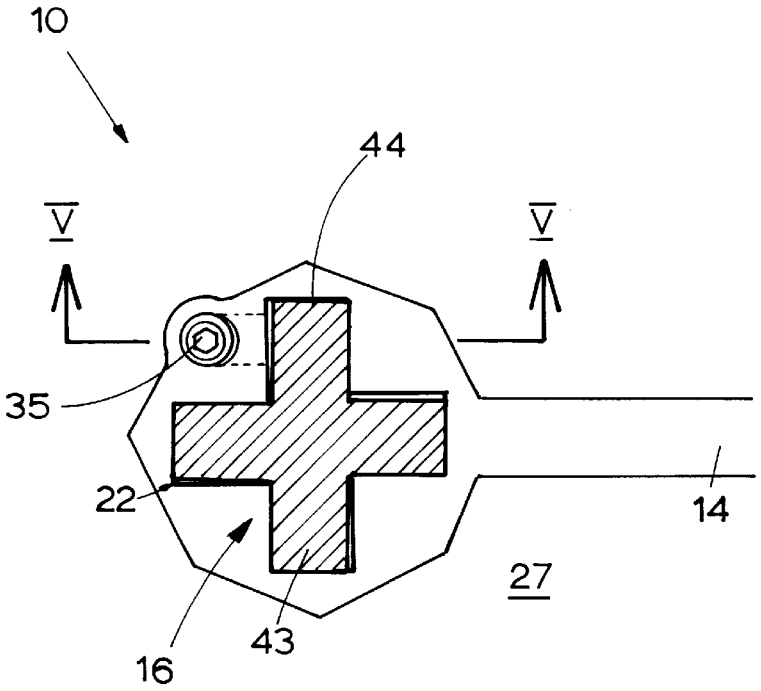
FIG. 4 is a sectional plan view of the fin assembly of FIG. 1, section through IV—IV in FIG. 5.
Figure 5:
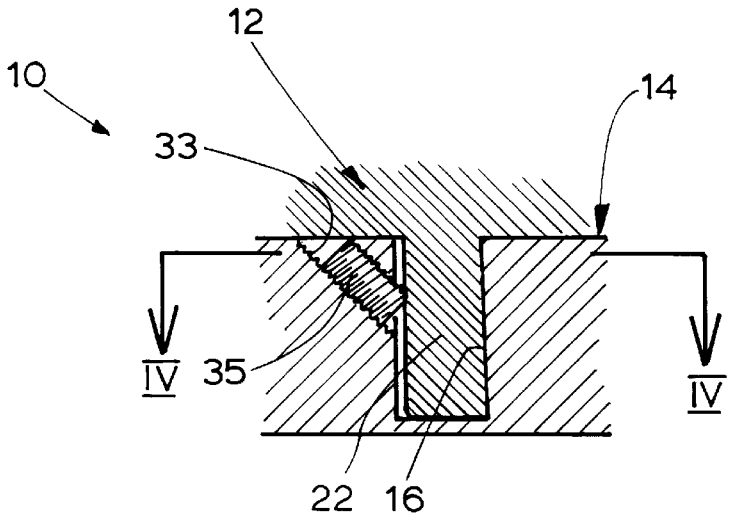
FIG. 5 is a sectional front view of a spigot of the fin assembly of FIG. 1, section through V—V in FIG. 4.

The grub screws 35 and 36 are screwed down into the passageways 33 until they wedge tightly against the adjacent lateral arms 44 and 45 of the cruciform fin spigots 22 and 23. As the grub screws 35 and 36 are on opposite sides of the fin 12 they tend to rotate the cruciform spigots 22 and 23. This action wedges them under the inclined wall of the sockets enhancing their retention in the sockets. The rotation of the elements is shown clearly in FIG. 4 and the effect created by the tapered wall of the socket is shown in FIG. 5.

Figure 6:
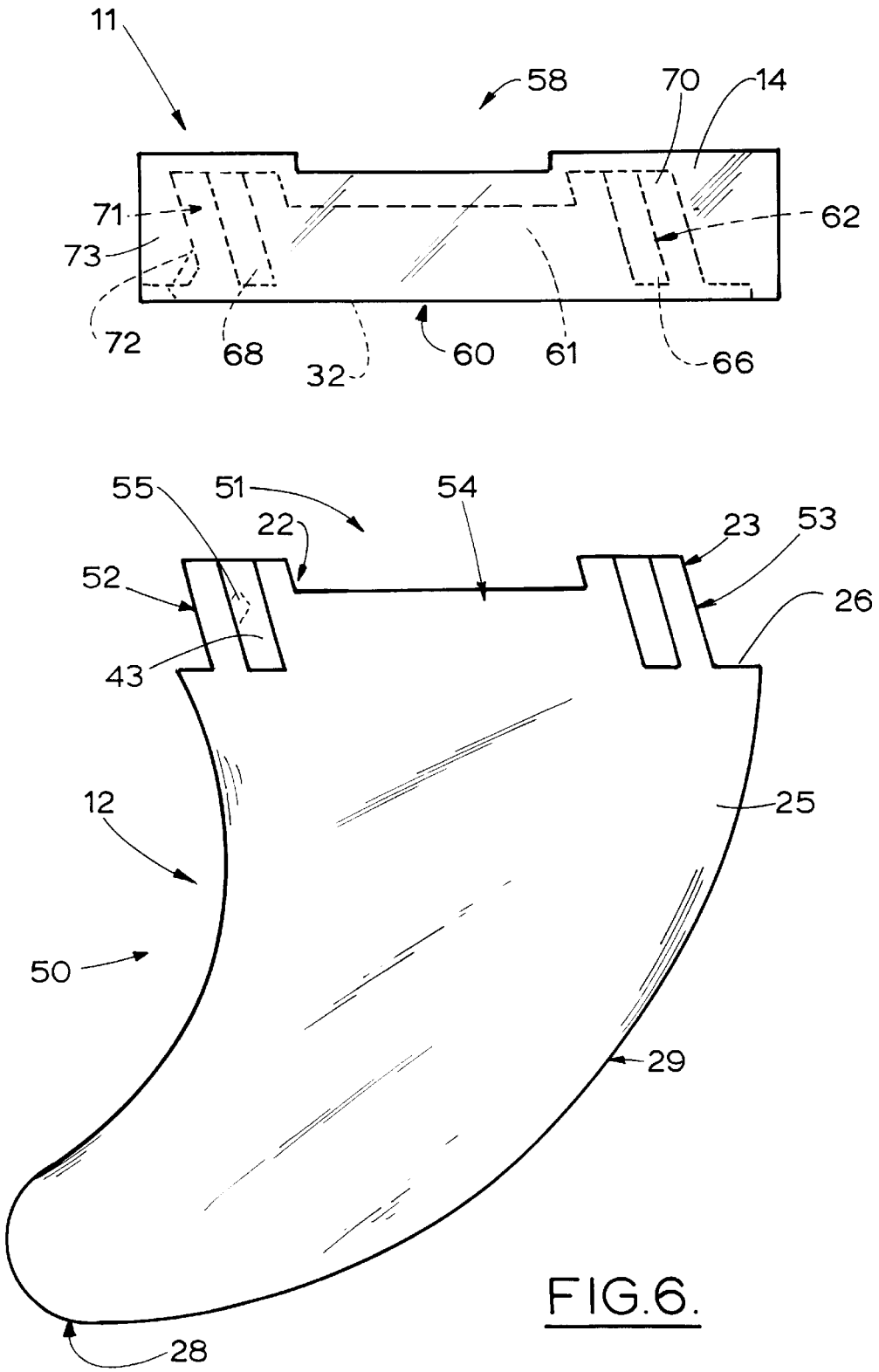
FIG. 6 is an exploded side view of a fin assembly in accordance with a second embodiment of the invention.
Figure 7:
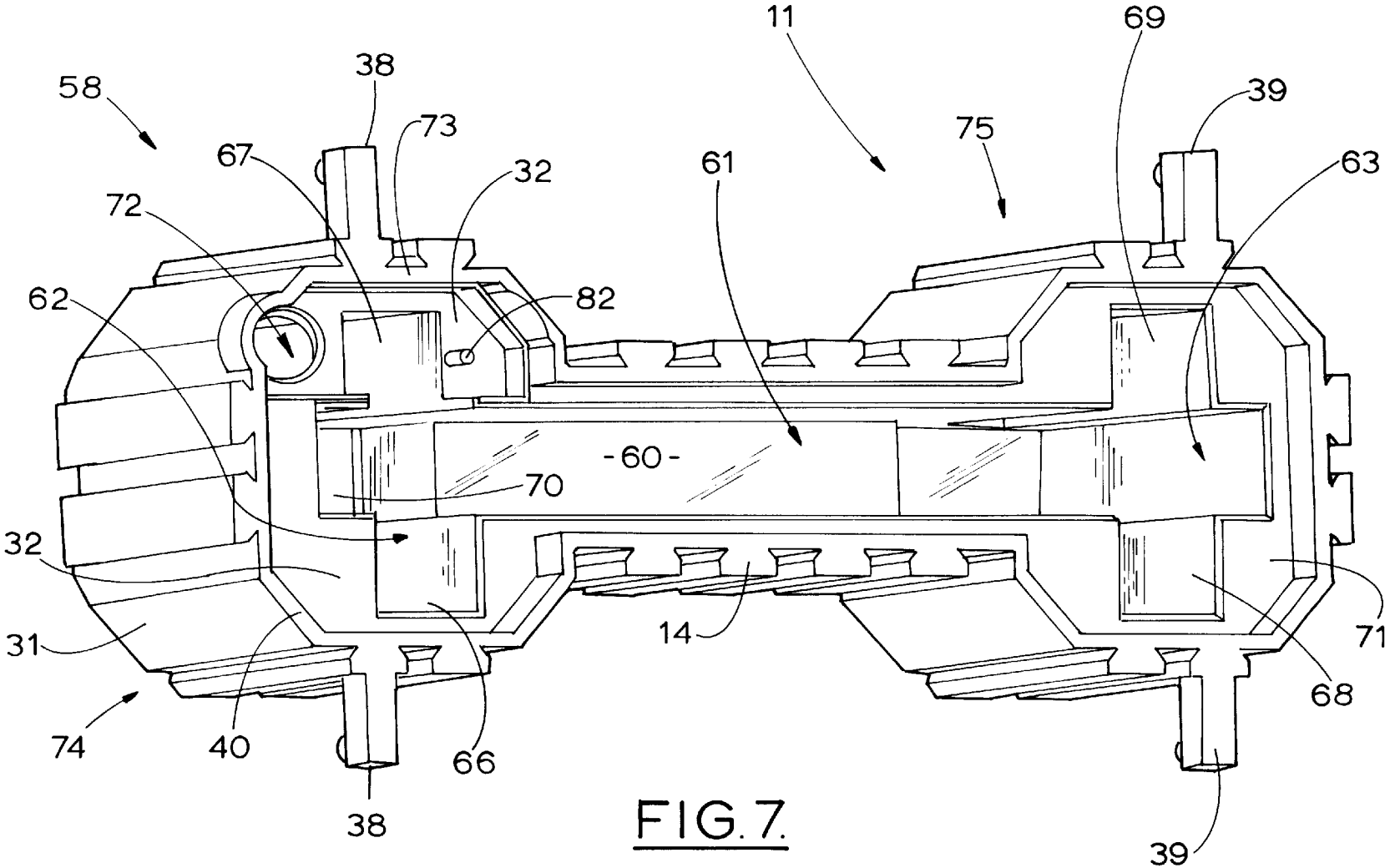
FIG. 7 is a schematic three dimensional view from one end of a socket mounting for the fin assembly of FIG. 6.
Figure 8:
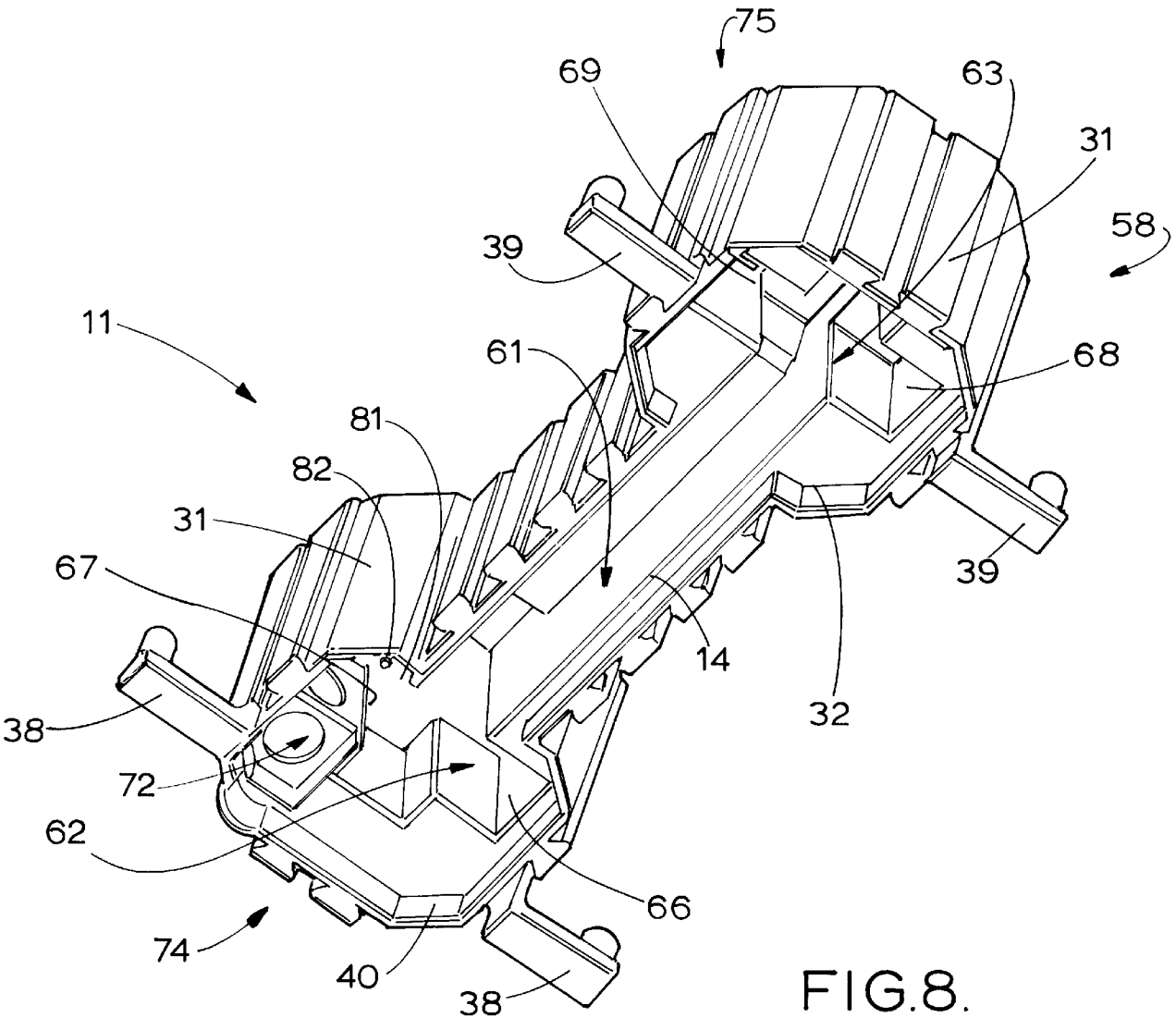
FIG. 8 is a schematic three dimensional view from the other end, of the socket mounting of FIG. 7.
Figure 9:
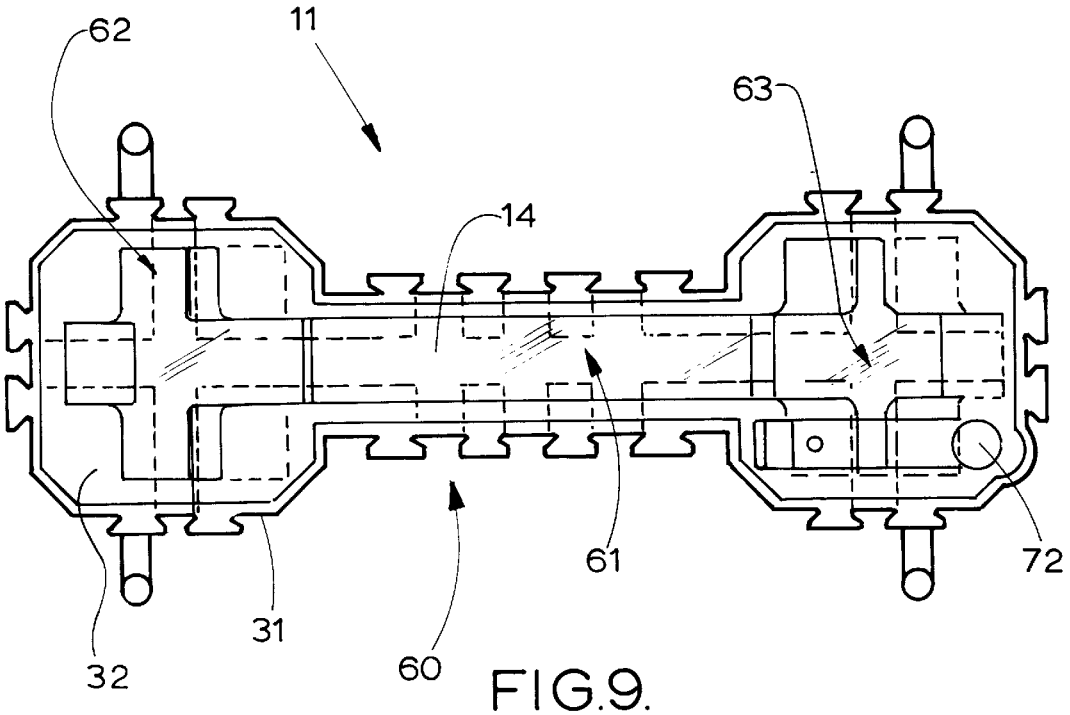
FIG. 9 is a plan view of the socket mounting of FIG. 7.

FIG. 6 illustrates a fin assembly 10 in accordance with a second embodiment. The fin assembly 50 is functionally and structurally similar to the fin assembly 10 of FIG. 1 and unless otherwise indicated the same reference numerals will be used to refer to the same components.

Figure 10:
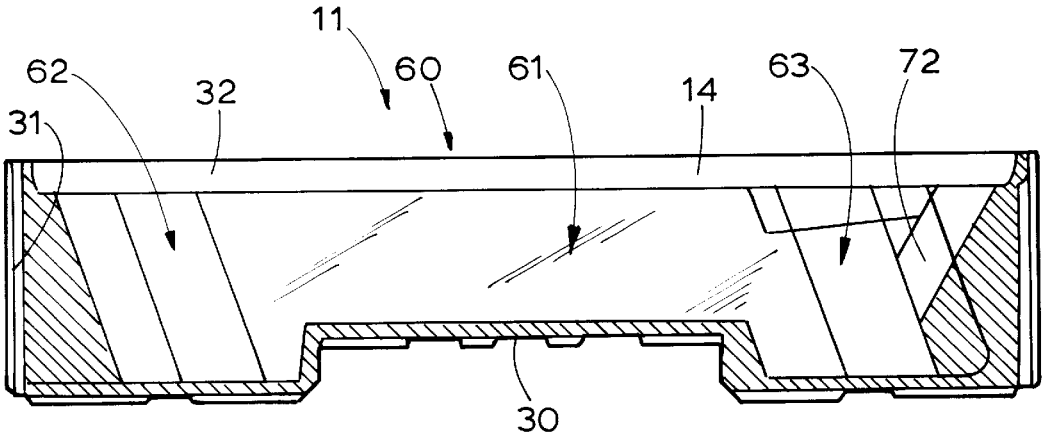
FIG. 10 is a sectional side view of the socket mounting of FIG. 7.
Figure 11:
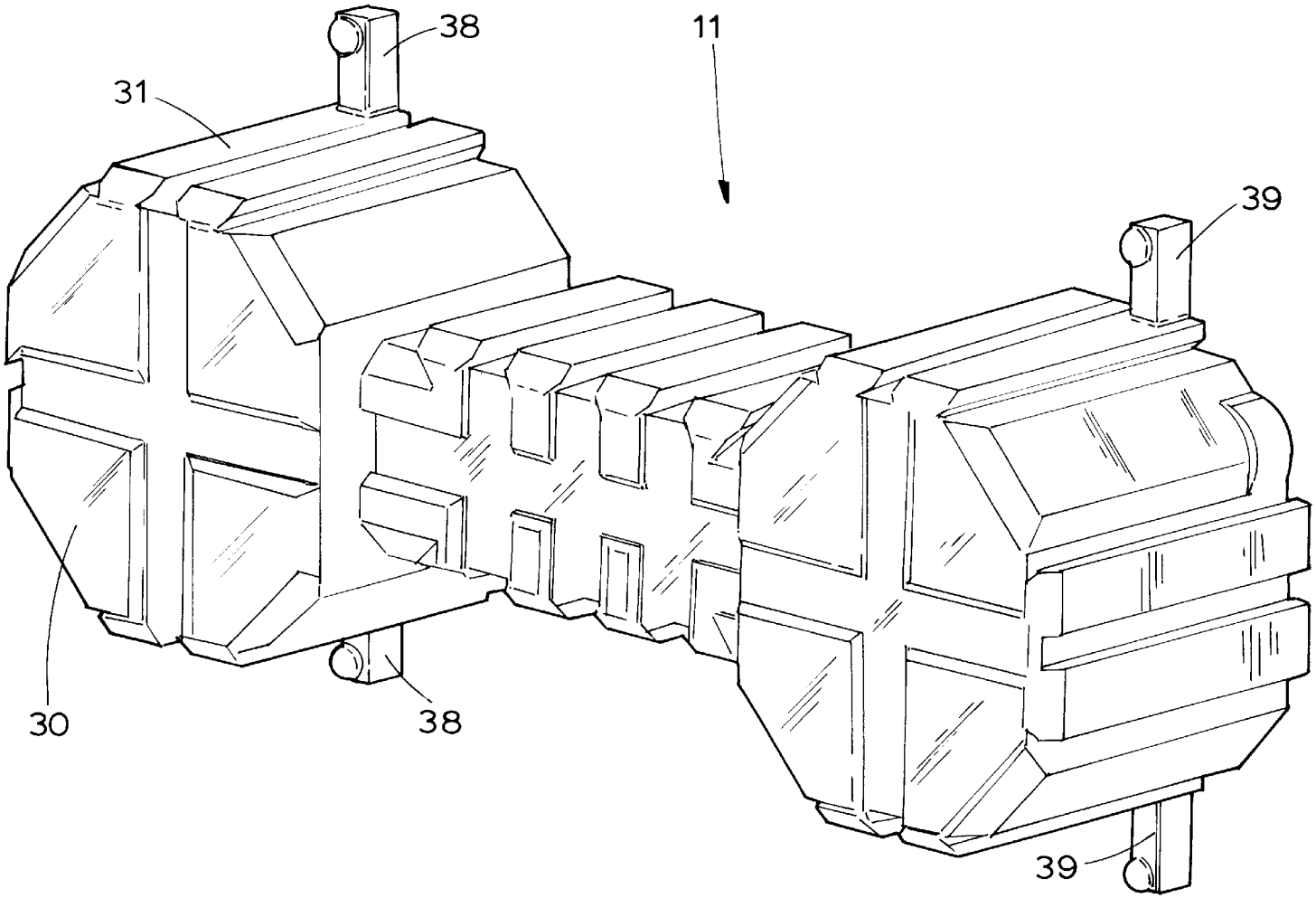
FIG. 11 is a bottom three dimensional view of the socket mounting of FIG. 7.

In FIG. 6 the fin assembly 50 has a fin body 12 and a single attachment spigot 51. The attachment spigot 51 comprises a linear central section 54 and cruciform shaped end sections 52 and 53 at each end of the central section 54. The end sections 52 and 53 slope backwardly away from the leading edge 29 of the fin 12 at an angle of approximately 20° to the vertical as shown in the drawings and particularly FIG. 10. A recess 55 is defined in the arm 43 of the rear cruciform end section 52 for receiving the leading edge of a fastening element, such as a grub screw 35 as illustrated in FIG. 12.

The socket mounting 58 has a single socket 60 complementary to the fin attachment spigot 51. That is the socket 60 has a linear central section 61 and cruciform socket formations 62 and 63 at each end of the central section 61. The cruciform socket formations 62 and 63 have respectively two lateral arms 66, 67 and 68, 69 and two longitudinal arms 70 and 71.

An inclined passageway 72 is defined in the housing 73 from the top wall 32 thereof through to a lateral arm 68 or 69 of the rear socket formation 63 in the manner of the passageway 33 of the previous embodiment. A grub screw 35 is passed through the passageway 72 to anchor the fin attachment spigot 51 to the socket mounting 60.

A locking pin 76 may be received in the passageway 72 in lieu of the grub screw 35 for engagement in the arm 68 or 69. Such a locking pin 76 is shown clearly in FIG. 13.

Referring to FIGS. 7 to 11 it will be seen that the socket mounting 58 includes opposed pairs of temporary supports 38 and 39, each pair projecting laterally from each end section 74 and 75. These supports are used for the same purpose as described above but are arranged in laterally spaced pairs to provide a more stable temporary location of the socket mounting 58.

The side wall 31 of the housing 73 is complex in shape as per the previous embodiment. However it includes a plurality of vertical wedge section ribs to enhance its retention in the board 13.

The top wall 32 of the housing adjacent the passageway 72 has a shallow surface recess 81 and a clip formation 82 for locating and attaching a locking pin 76 to the housing 73.

FIGS. 14 to 16 illustrate a fin assembly 80 which varies from the second embodiment illustrated in FIGS. 6 to 13 in that the transverse faces of the spigot 81 slope forwardly as opposed to sloping rearwardly.

In this fin assembly 80 the fastening element, be it grub screw 35 or locking pin 76 and the associated passageway 82 are located proximate to the leading edge 29 of the fin body 12 rather than remote from it. Thus the leading edge is positively locked into the leading end section 84 by the grub screw 35 or locking pin 76.

FIGS. 15 and 16 show the attachment of the fin 12 to the socket mounting 90 by means of both grub screws 35 and locking pins 76. The structure of the fin 12 in FIG. 13 is basically the same as that in FIG. 6.

Other differences of detail are that the socket mounting 90 is longer than the fin base 91 and the head of the locking pin 76 is not received in a recess.

In another variation of the FIG. 6 embodiment which has not been illustrated, the fin attachment element projects perpendicularly from the base of the fin. In this way the fin can be displaced directly towards and into the socket mounting without any need for pivoting in much the same way as the FIG. 1 embodiment.

In yet another variation of the FIG. 6 embodiment which has not been illustrated, the fin assembly has two grub screws or locking pins spaced from each other, ie disposed towards each end of the fin. Typically these would engage a lateral arm on each of the cruciform end sections.

An advantage of the fin assemblies described in detail with reference to FIGS. 6 to 16 is that it is easy to mount on a board. By virtue of the fact that there is only a single socket mounting to position on the board, the precise position of the element is not critical. The spigot will always be able to fit into the socket mounting. In a prior art fin assembly which has two separate and discrete socket mountings, the spacing of the socket mountings on the board is absolutely critical to successfully fit the assembly. This is a difficult and precise operation to perform.

Further in the applicant's FIG. 6 fin assembly, there is only one fastening element instead of the four for the prior art fin assembly. In addition locking pins are easier to work with because they do not require a hex nut or screw driver as do the grub screws. This is particularly so for surfers on the beach.

A yet further advantage of the fin assembly described is that the socket mounting does not require a passage to be formed through to the top skin and the formation of a resin plug extending from the socket mounting to the top skin. The size and configuration of the socket mounting of the present invention will enable it to be mounted to a board body without the need to fill form a cavity extending between the skins which requires filling with a resin plug.

Furthermore, as described broadly above the inclination of the sockets and provision of corresponding spigots of constant longitudinal section provide a secure mounting which is secure and assists in the prevention of damage to the board by fore and aft rocking of the fin.

In the embodiments described above, the spigots all have a substantially constant fore and aft section throughout their length. While they could taper in fore and aft section, and withdrawal from the fully home position would render the spigots loose in their sockets. This would be particularly disadvantageous in the embodiments in which the spigots slope either forwardly or rearwardly from the fin body and are secured with a single grub screw, for example.

It will of course by realised that the above has been given only-by way of illustrative example of the invention and that all such modifications and variations thereto as would be apparent to persons skilled in the art are deemed to fall within the broad scope and ambit of this invention as is defined in the appended claims.

The claims defining this invention are as follows:

1. A fin assembly including:

a fin having a fin body that defines a tip and a mounting base and opposed major surfaces extending from the tip to the mounting base, and at least two spigots projecting away from the mounting base that are spaced apart in a direction of the length of the mounting base, each spigot sloping either forwardly, rearwardly, or laterally away from the mounting base of the fin body;

a socket mounting for permanent inclusion in a surfboard to which the fin is to be mounted, the socket mounting having a socket face defining spigot sockets corresponding with and complementary to the spigots on the fin so that the spigots can be received in the respective spigot sockets; and a securing means for releasably securing the fin to the socket mounting.

2. A fin assembly according to claim 1 wherein each spigot defines at least one guide formation for guiding sliding displacement of the spigot into and out of the socket.

3. A fin assembly according to claim 1 wherein each spigot has a substantially constant section along the length thereof and each spigot is inclined either forwardly or rearwardly relative to the fin body.

4. A fin assembly according to claim 1 wherein each spigot includes at least one lateral projection and wherein the corresponding spigot sockets define complementary lateral formations for receiving the lateral projections.

5. A fin assembly according to claim 4, wherein each spigot has a lateral projection on each side thereof and wherein each lateral projection slopes relative to the mounting base at substantially the same angle as the corresponding spigot.

6. A fin assembly according to claim 1 wherein the fin further includes a section projecting away from the mounting base intermediate the spigots which strengthens the fin, and wherein the socket mounting defines a complementary intermediate socket intermediate the spigot sockets.

7. A fin assembly according to claim 6, wherein each spigot has a substantially cruciform configuration and the socket mounting has enlarged end sections within which cruciform sockets are defined.

8. A fin assembly according to claim 1 wherein the socket mounting defines an inclined passage extending from the socket face through the socket mounting down to a said spigot socket, and wherein the releasable securing means comprises a releasable securing element received within the passage for engaging a said spigot.

9. A fin assembly according to claim 8, wherein the inclined passage extends broadly parallel to the major surfaces of the fin and the securing element engages a surface of the spigot extending broadly transversely to the direction of the length of the mounting base.

10. A fin assembly according to claim 9 wherein the securing element engages either a front face of a forwardly sloping spigot or a rear face of a rearwardly sloping spigot.

11. A fin assembly according to claim 8 wherein the releasable securing element is a grub screw having an external screw thread engaging a complementary internal screw thread defined in the inclined passage.

12. A fin assembly according to claim 1 wherein the fin is formed as a one piece molding of plastics material.

13. A fin assembly according to claim 1 wherein the socket mounting is formed as a one piece molding of plastics material.

14. A fin assembly as claimed in claim 1 wherein the socket mounting has a multifaceted side wall to provide increased surface area for bonding the socket mounting to a board in which it is to be included.

15. A fin assembly as claimed in claim 14 wherein the socket mounting has a peripheral collar projecting upwardly around the periphery of the socket face, and at least two supports extending outwardly from the collar for supporting the socket mounting on a board in which it is to be included at points spaced outwardly from the peripheral collar.

16. A fin for a socket mounting having a face defining at least two spigot sockets therein, the fin including:

a fin body defining a tip and a mounting base and opposed major surfaces extending from the tip to the mounting base, and at least two spigots projecting from the mounting base that are spaced apart in a direction of the length of the mounting base, the spigots being configured and sized to be snugly received within the spigot sockets of the socket mounting and the spigots sloping either forwardly, rearwardly, or laterally away from the mounting base of the fin body.

17. A fin according to claim 16 further including a section projecting away from the mounting base intermediate the spigots for strengthening the fin and for being received within a complementary intermediate socket within the socket mounting.

18. A socket mounting for a surfboard fin with which it forms a fin assembly, the socket mounting including:

a socket body for permanent inclusion in a surfboard to which the socket mounting is to be mounted, the body having a socket face defining at least two spigot sockets corresponding with and complementary to spigots on the associated fin, the spigot sockets sloping either forwardly, rearwardly or laterally relative to the socket face.

19. A socket mounting according to claim 18 further including a securing means for releasably securing a said spigot on the fin to the socket body.

20. A socket mounting according to claim 19, wherein the socket mounting defines an inclined passage extending from the socket face through the socket mounting down to a said spigot socket, and wherein the releasable securing means comprises a releasable securing element received within the passage for engaging a said spigot.

21. A socket mounting according to claim 18 wherein the socket body has a side wall which is multi-faceted to increase the surface area of the side wall for bonding the socket body to the board in which it is to be included.

22. A socket mounting according to claim 18 wherein the socket body further includes an intermediate socket intermediate the spigot sockets for receiving a section of the fin projecting away therefrom intermediate the spigots.

23. A fin assembly including:

a fin body having a mounting base and spigots projecting from front and rear positions on the base;

a complementary front socket and a complementary rear socket for inclusion in a board for receiving the spigots for releasably mounting the fin assembly to the board;

releasable securing means for securing the fin assembly in said mounting, wherein the spigots have a substantially constant fore and aft section throughout their length and slope either forwardly or rearwardly from the fin body.

* * * * *